US006257009B1

(12) United States Patent
Tsuchikawa

(10) Patent No.: US 6,257,009 B1
(45) Date of Patent: Jul. 10, 2001

(54) ICE DISPENSER

(75) Inventor: Koji Tsuchikawa, Aichi-ken (JP)

(73) Assignee: Hoshizaki Denki Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 09/422,462

(22) Filed: Oct. 21, 1999

(30) Foreign Application Priority Data

Oct. 21, 1998 (JP) ..... 10-299790

(51) Int. Cl.[7] ..... F25C 1/00
(52) U.S. Cl. ..... 62/233; 62/354
(58) Field of Search ..... 62/354, 233

(56) References Cited

U.S. PATENT DOCUMENTS

| | | | | |
|---|---|---|---|---|
| 3,651,656 | | 3/1972 | Esser et al. . | |
| 4,496,087 | | 1/1985 | Marks . | |
| 4,741,173 | * | 5/1988 | Neumann | 62/354 |
| 4,787,539 | | 11/1988 | Uchida et al. . | |
| 4,846,381 | * | 7/1989 | Kito et al. | 62/233 |
| 4,982,573 | * | 1/1991 | Tatematsu et al. | 62/233 |
| 5,230,448 | | 7/1993 | Strohmeyer et al. . | |

FOREIGN PATENT DOCUMENTS

| | | |
|---|---|---|
| 57-125975 | 1/1956 | (JP) . |
| 61-66763 | 5/1986 | (JP) . |
| 61-27033 | 8/1986 | (JP) . |
| 63-143476 | 6/1988 | (JP) . |
| 63-254367 | 10/1988 | (JP) . |
| 5-210784 | 8/1993 | (JP) . |

* cited by examiner

*Primary Examiner*—Michael Powell Buiz
*Assistant Examiner*—Mohammad M. Ali
(74) *Attorney, Agent, or Firm*—Wenderoth, Lind & Ponack, L.L.P.

(57) ABSTRACT

An ice dispenser operates an agitator only when necessary so as to prevent ice in an ice storage compartment from fusing and sticking to each other, thereby ensuring smooth release of ice from the ice storage compartment. The ice dispenser is formed of an ice maker, an ice storage compartment, an ice releasing port, an agitator for agitating ice in the ice storage compartment, and an operation controller. The controller operates the agitator when releasing ice and making ice, and causes the agitator to operate for a predetermined second set time after allowing an interval of a predetermined first set time to pass by using a timer means when no ice is being made. The operation controller resets the timer means to start counting the first set time when an ice release or an ice making operation is stopped and the agitator is stopped.

5 Claims, 5 Drawing Sheets

ICE DISPENSER

BACKGROUND OF THE INVENTION

1. Field of the Invention

The present invention relates to an ice dispenser and, more particularly, to operational control of an agitator in an ice storage compartment of an ice dispenser.

2. Description of the Related Art

Conventionally, in this type of ice dispenser, an agitator is installed in an ice storage compartment and actuated periodically in order to prevent pieces of ice in the ice storage compartment from melting and sticking to each other to form a large chunk of ice so as to interfere with smooth dispensing of the ice, and to prevent deterioration of ice quality. This is disclosed in, for example, Japanese Utility Model Publication No. 61-27033.

In the case of Japanese Utility Model Publication No. 61-27033, when the ice storage compartment becomes full, the ice making operation is stopped and a timer simultaneously starts counting to rotate a fin (agitator) for agitating each time a set time passes. In this type of ice dispenser, the agitating fin is also actuated when ice is released. Further, in the control of the agitating fin in the conventional art described in the foregoing publication, the timer is not reset when the agitating fin is operated for the release of the ice. Therefore, immediately after the ice is released and the agitating fin is operated during a halt in the ice making operation, the timer count reaches a set count value, causing the agitating fin to operate again. However, where the interval for operating the agitating fin is shorter than necessary and the agitating fin is operated as in the above case, ice tends to melt due to the frictional heat of the agitating fin. Hence, conditions are created in which fusion of the ice will easily occur. Consequently, up until now fusion of ice could not be sufficiently prevented.

SUMMARY OF THE INVENTION

Accordingly, the present invention has been made with a view toward solving the problems described above. It is an object of the invention to provide an ice dispenser adapted to minimize the operation of an agitator in an ice storage compartment in order to prevent pieces of ice from fusing and sticking to each other in the ice storage compartment to thereby ensure smooth release of the ice from the ice storage compartment, and also to maintain consistent quality of the ice to be dispensed.

To this end, according to the present invention, an ice dispenser is provided with: an ice maker, an ice storage compartment, an ice releasing port, an agitator for agitating ice in the ice storage compartment, and an operation controller that operates the agitator when releasing ice and making ice, and causes the agitator to operate for a predetermined second set time after allowing an interval of a predetermined first set time to pass by using a timer means when no ice is being made. The operation controller resets the timer means to start counting the first set time when an ice releasing operation or an ice making operation is stopped and the agitator is stopped.

With this arrangement, when the agitator has been operated for the ice releasing operation or ice making operation, counting of the first set time is started as soon as the operation of the agitator is stopped. Therefore, the agitator will not be operated again immediately after the agitator has been operated for releasing or making ice, and the agitator is automatically operated at predetermined time intervals, thus solving the problem of unnecessary operation of the agitator.

DESCRIPTION OF THE PREFERRED EMBODIMENTS

Embodiments wherein the present invention is embodied by auger type ice machines will be described with reference to FIG. 1 through FIG. 5. Regarding the structures of the auger type ice machines of the embodiments, FIG. 1 shows the entire schematic composition of an auger type ice machine, and FIG. 2 shows a specific portion of the auger type ice machine.

Figure 1:
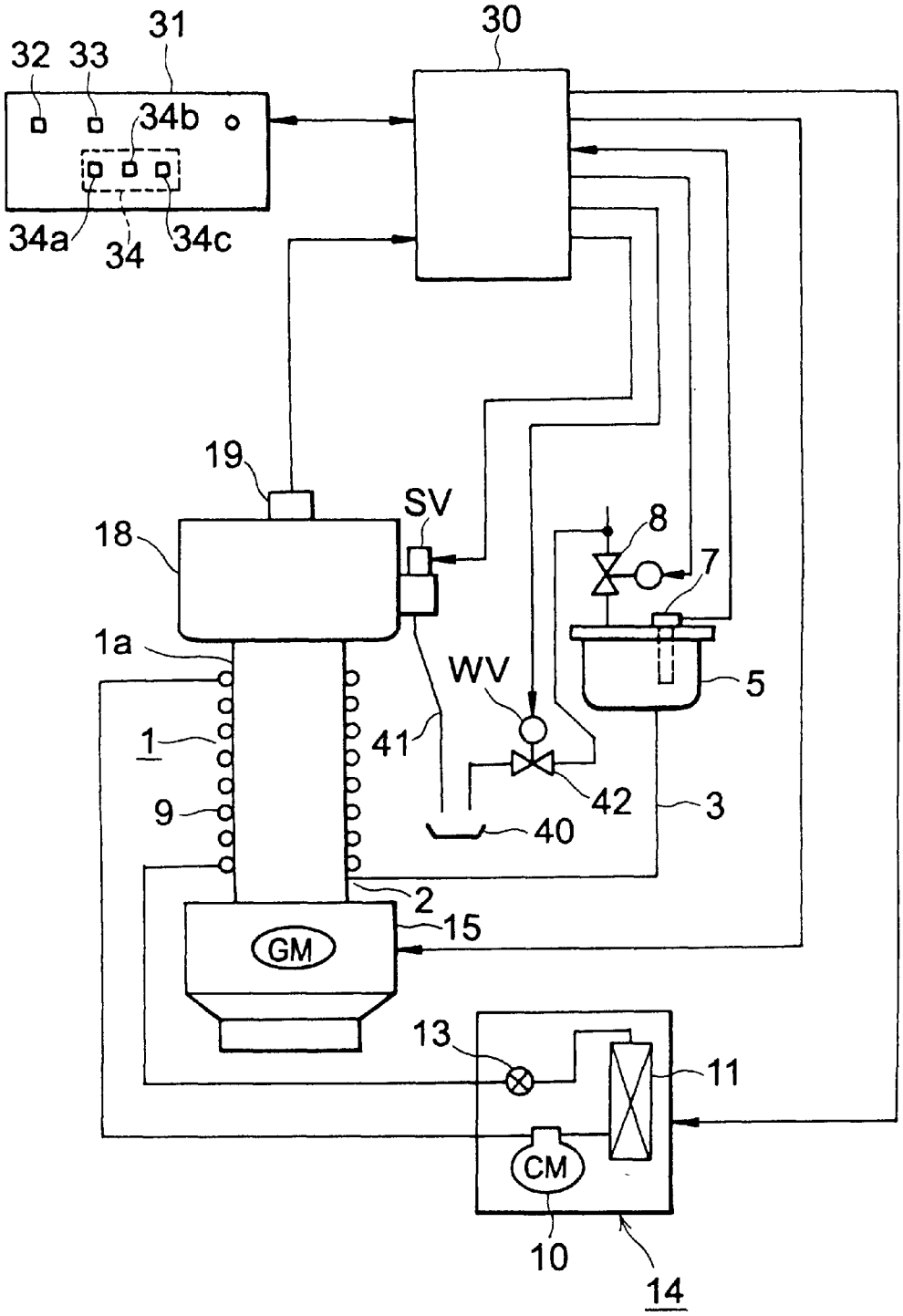
FIG. 1 is a diagram showing a general schematic composition of an auger type ice machine in accordance with an embodiment of the present invention.
Figure 2:
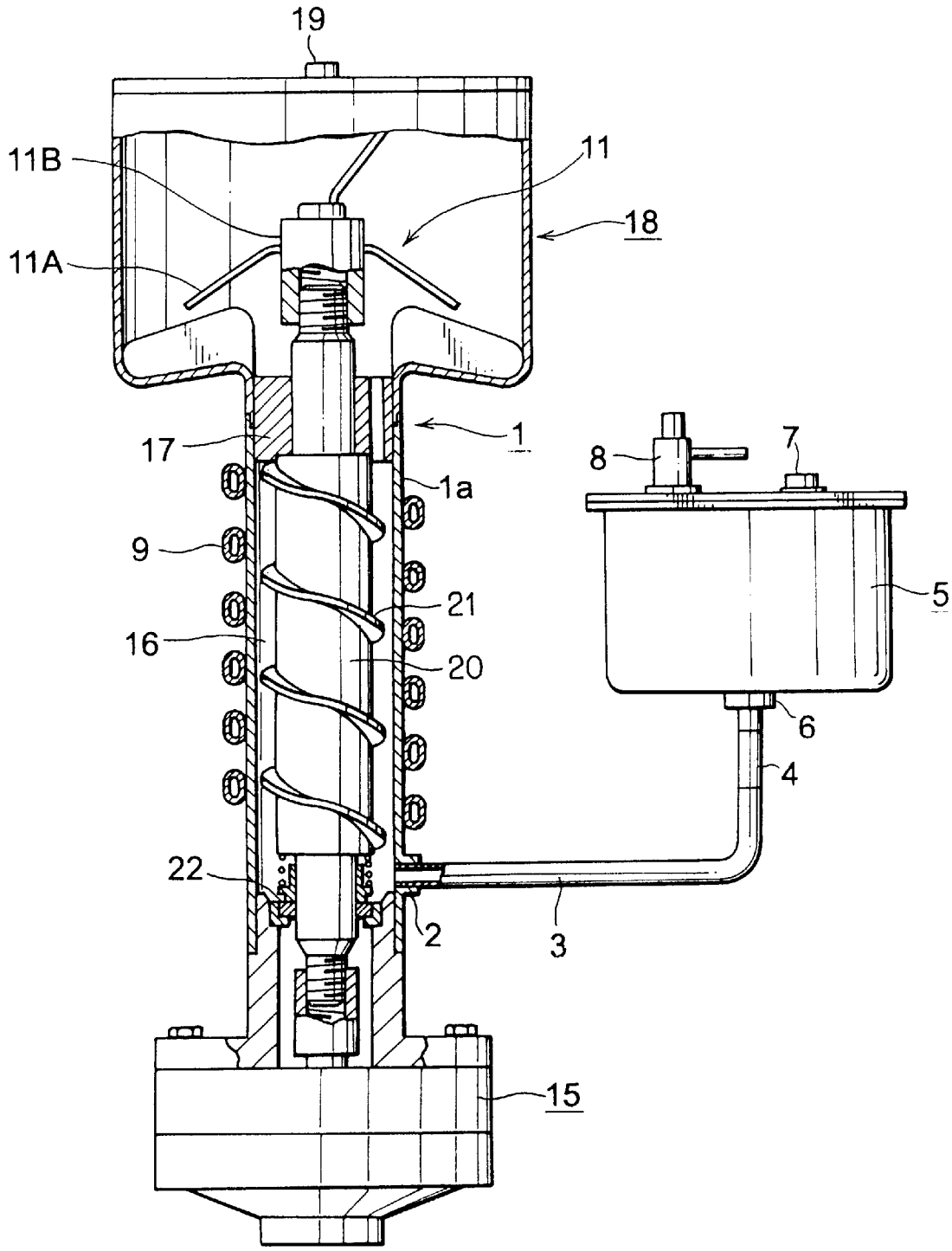
FIG. 2 is a diagram showing a portion of the ice maker of the ice machine.

As shown in FIG. 1, the auger type ice machine is constructed primarily of an ice maker 1 with an ice making cylinder 1*a* located at a center thereof, an ice storage compartment 18 provided on the top of the ice maker, an ice making water rank 5 provided on a side of the ice maker 1, a refrigerating device 14 for cooling the ice making cylinder 1*a*, a control panel 31, and a controller 30.

The ice making cylinder 1*a* made of stainless steel or the like is installed so that it is perpendicular to the main body of the ice machine. A water supply port 2 is provided at the bottom of the ice making cylinder 1*a* as shown in FIG. 2. One end of a water supply pipe 3 is connected to the water supply port 2, and the other end of the water supply pipe 3 is connected to a water supply port 6 provided at the bottom of the ice making water tank 5 via a connection hose 4. Thus, ice making water stored in the ice making water tank 5 is supplied into the ice making cylinder 1*a* via the connection hose 4 and the water supply pipe 3.

An auger 16 is provided in the ice making cylinder 1*a*. The auger 16 has a spiral blade 21 provided around a rotary shaft 20 and is coupled to a geared motor (GM) 15, which serves as a driving device, at the bottom end thereof. Reference numeral 22 denotes a mechanical seal that hermetically seals the bottom end of the ice making cylinder 1*a* at the bottom end of the rotary shaft 20.

An evaporator 9 which is a spirally wrapped cooling pipe is provided on an outer peripheral surface of the ice making cylinder 1*a*. The evaporator 9 cools the ice making cylinder 1*a*, and constitutes an evaporator of the refrigerating device 14. The refrigerating device 14 is formed of a refrigerant circuit in which a compressor (CM) 10, a condenser 11, an expansion valve 13, the evaporator 9, etc. are connected in this order as shown in FIG. 1.

The ice making water rank 5 is provided with a float switch 7. The float switch 7 senses an upper limit water level and a lower limit water level in the ice making water tank 5. When the float switch 7 senses the lower limit water level in the ice making water tank 5, a water supply valve 8 provided in a water supply circuit is opened by the control of the controller 30 to supply ice making water into the ice making water rank 5. Likewise, when the float switch 7 senses the upper limit water level in the ice making water tank 5, the water supply valve 8 is closed to stop the supply of water to the ice making water tank 5.

An ice storage compartment 18 stores ice sent from the ice making cylinder 1*a*. To be more specific, ice making water is supplied from the ice making water tank 5 to the ice making cylinder 1*a* and the refrigerating device 14 is driven to begin the ice making operation of the auger type ice machine. In this case, the cooling operation of the refrigerating device 14 cools the ice making water in the ice making cylinder 1*a*, causing thin ice to be formed on an inner wall surface of the ice making cylinder 1*a*. Then, this thin ice is scraped by the auger rotationally driven by the geared motor (GM) 15, transferred up to the top of the ice making cylinder 1*a*, and compressed and solidified by a pressing head 17 provided at the top of the ice making cylinder 1*a*. Next, the compressed and solidified ice is passed through a cutter (not shown), moved out into the ice storage compartment 18 provided at the top end of the ice making cylinder 1*a*, and stored therein.

The ice storage compartment 18 is provided with an ice storage switch 19 similar to a conventional one. The ice storage switch 19 is turned ON when the amount of stored ice in the ice storage compartment 18 reaches a set upper value of the ice storage switch 19 (i.e., a full ice amount value, based on the amount of ice that fills up the ice storage compartment 18). The ice storage switch 19 is turned OFF when the amount of ice stored in the ice storage compartment 18 is reduced by a certain amount from the set upper value or the full ice amount value and reaches set a lower value. Furthermore, the ice storage switch 19 issues an ON signal to the controller 30 when it senses that the amount of ice stored in the ice storage compartment 18 reaches the set upper value or the full ice amount value, while it issues an OFF signal to the controller 30 when it senses that the amount of ice stored in the ice storage compartment 18 reaches the set lower value as the ice is used and the amount of ice stored in the ice storage compartment 18 decreases.

The ice storage compartment 18 is provided with a release port through which ice is released. The release port is provided with an electromagnetic opening/closing door SV (see FIG. 1), and an ice release passage 41 which leads to a receiving pan 40 via the electromagnetic opening/closing door SV. Furthermore, a water supply pipe 42 connected in parallel to the water supply valve 8 is led out to the receiving pan 40 to permit supply of water to a consumer, a water valve WV, which serves as an opening/closing valve, being installed midway therein.

An agitator 11 with agitating rods 11A radially extending from a rotary shaft 11B is provided in the ice storage compartment 18. The rotary shaft 11B of the agitator 11 is coupled to an upper shaft end of the rotary shaft 20 of the auger 16. Hence, the agitator 11 is constructed to rotate integrally with the auger 16 by being driven by the geared motor (GM) 15.

The operation of the auger type ice machine is controlled by the controller 30 according to operating instructions received from the control panel 31. The control panel 31 is equipped with an ice making switch 32, a release switch 33, and selection keys 34 for selecting between the release of water and the release of ice. The selection keys 34 includes keys 34*a*, 34*b*, and 34*c* to permit selection from among three different release modes, namely, "water only", "ice only", and "water and ice".

The controller 30 includes a microcomputer, memories, etc. The controller 30 receives ON/OFF signals from the ice making switch 32 and ON/OFF signals from the release switch 33 on the control panel 31, and further receives ON/OFF signals from the ice storing switch 19, the float switches 7, etc., thus forming an operation controller as set forth hereinafter.

Figure 3:
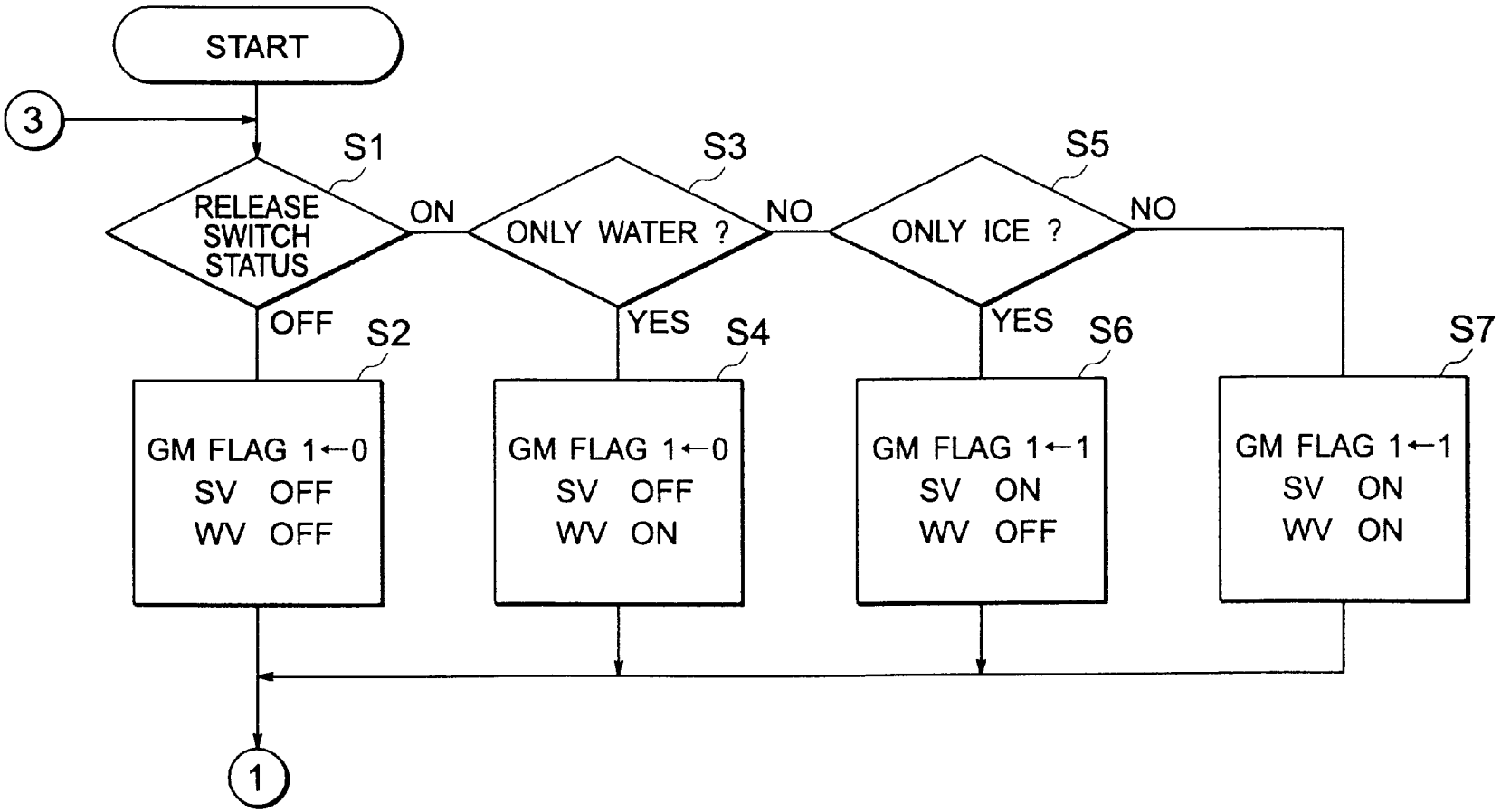
FIG. 3 is a flow chart of a release mode for an operation controller of the ice machine.

FIG. 3 shows a flow chart of the operation controller in a release mode. First, in step SI, the state of the release switch 33 is checked If the release switch 33 is OFF, then there will be no command for release, and therefore, no release will be carried out. In this case, the electromagnetic opening/closing door sv is closed (SV off), the water valve WV is closed (WV off), and a GM flag 1 is set to 0 in step S2. If the release switch 33 is ON in step S1, then it is determined in steps S3 and S5 which one of the selection keys 34 (34*a* water only), (34*b* ice only), and (34*c* water and ice) has been selected.

If the selection key 34*a* (water only) has been turned ON, then the determination result in step S3 is YES. Therefore, in step S4, the electromagnetic opening/closing door SV is closed (SV off), while the water valve WV is opened (WV on) to release water only, and the GM flag 1 is set to 0. If "ice only" has been selected, then the determination result in step s3 is NO, while it is YES in step S5. Hence, in step S6, the electromagnetic opening/closing door SV is opened (SV on), while the water valve WV is closed (WV off) to release ice only, and the GM flag 1 is set to 1. If "water and ice" has been selected, then the determination result in step S5 is NO. Hence, in step S7, electromagnetic opening/closing door SV is opened (sv on), and the water valve WV is also opened (WV on) to release both ice and water, and the GM flag 1 is set to 1.

Figure 4:
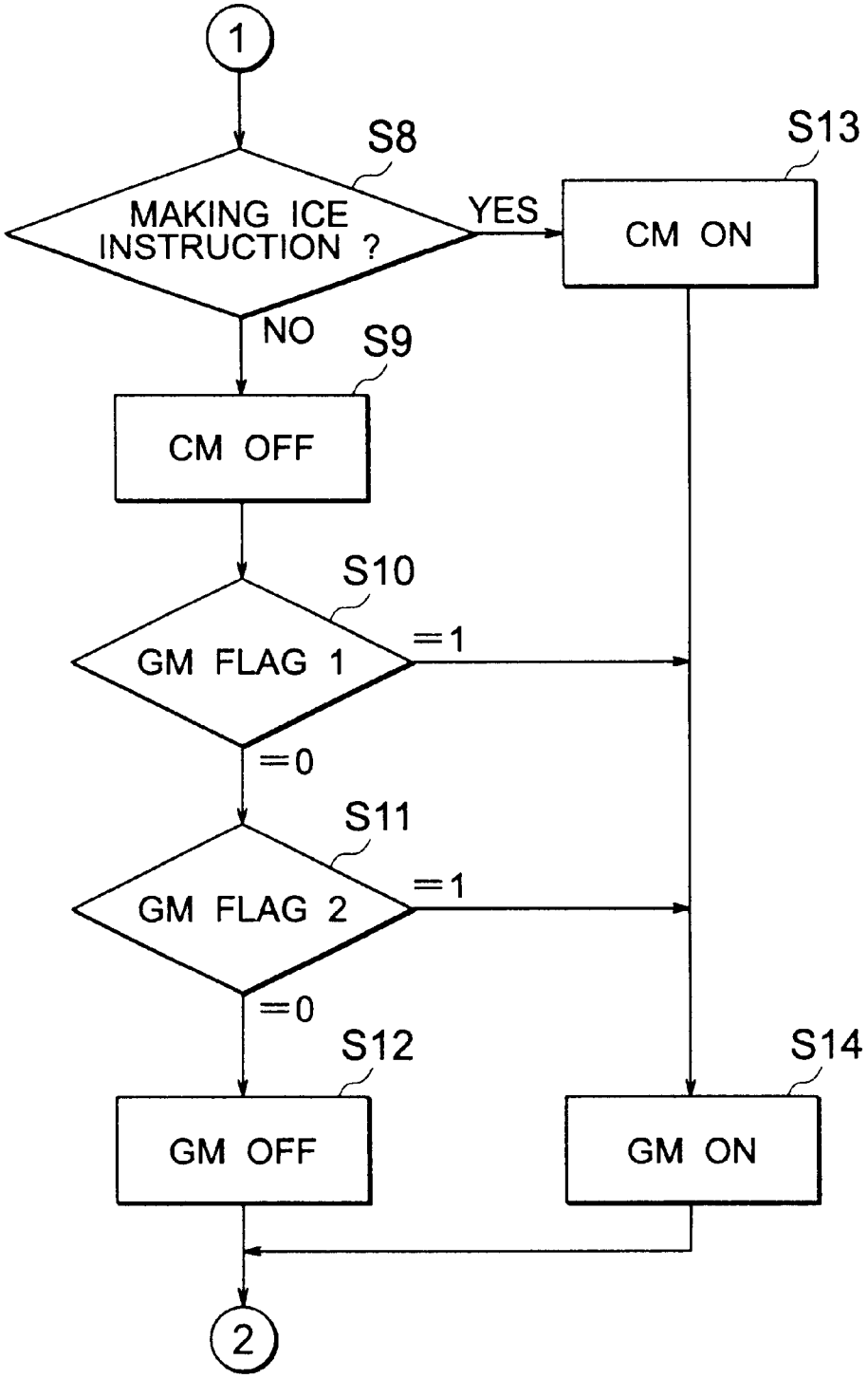
FIG. 4 is an operational flow chart of the ice making operation and a geared motor in the operation controller of the ice machine.
Figure 5:
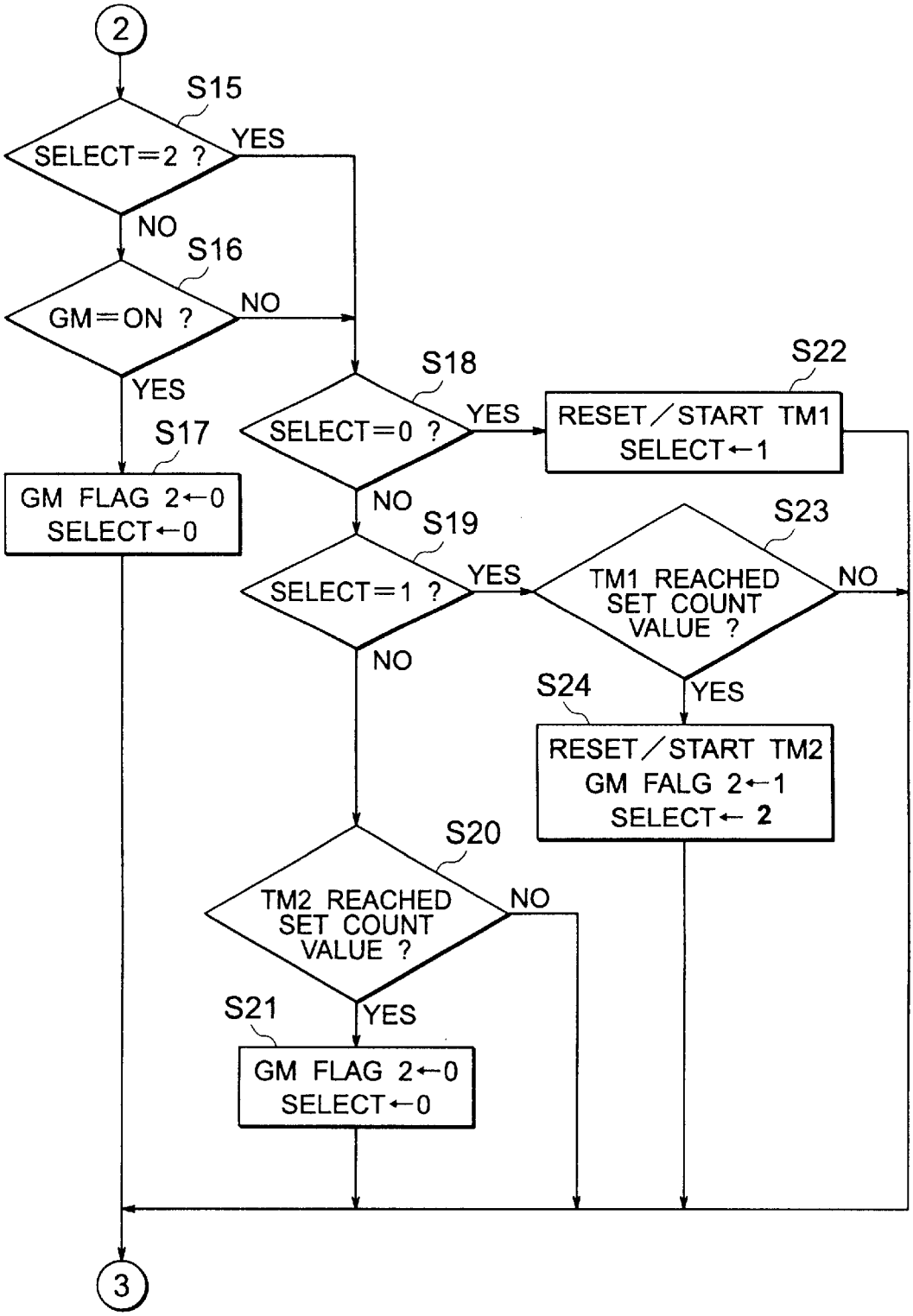
FIG. 5 is a timer control flow chart of an agitator or a geared motor in the operation controller of the ice machine.

FIG. 4 shows an operational flow chart of the ice making operation and the geared motor (GM) 15 (agitator 11) in the operation controller. FIG. 5 shows a timer control flow chart of the geared motor (agitator 11) in the operation controller.

As previously mentioned, after reaching the set upper value, the ice storage switch 19 is ON when the amount of ice stored in the ice storage compartment 18 has not yet reached the set lower value. In this case, an instruction for stopping the ice making operation is issued from the ice storage switch 19. Conversely, when the amount of stored ice is less than the set lower value, the ice storage switch 19 is OFF, meaning that an instruction for beginning the ice making operation is issued from the ice storage switch 19. These instructions are checked in step S8. If it is determined in step S8 that the instruction for making ice has been issued, then the compressor (CM) 10 and the geared motor (GM) 15 are actuated (CM on and GM on) in steps S13 and S14.

If it is determined in step S8 that the instruction for making ice has not been issued, then the compressor (CM) 10 is stopped in step S9. When ice is released in the ice releasing control (in the case of steps S6 and S7), the GM flag 1 is set to 1, so that the geared motor (GM) 15 is driven. Hence, when ice is released, the geared motor (GM) 15 is driven and the agitator 11 is operated (steps S10 to S14).

In step S11, it is determined whether a GM flag 2 is 0 or 1. The GM flag 2 is reset to 0 or 1 as described below in the timer control flow chart (i.e., the timer control flow chart of the geared motor (GM) 15 for the agitator 11) shown in FIG. 5.

More specifically, when a first timer TM1 starts counting and reaches a set value, a second timer TM2 starts counting, causing the GM flag 2 to be reset to 1 (steps S23 and S24). When the second timer TM2 reaches a set count value, the GM flag 2 is reset to 0 (steps S20 and S21). As will become obvious from a description to be given hereinafter, the agitator 11 is controlled such that it is stopped for a predetermined first set time when the ice making operation is stopped and no ice is being released, then operated for a predetermined second set time. The first timer TM1 monitors the first set time, while the second timer TM2 monitors the second set time.

Thus, when the first timer TM1 reaches a value indicating the first set time when it has been determined in step S8 that no instruction for making ice has been issued and no ice is being released under the ice release control (in the case of steps S2 and S4), the GM flag 2 is reset to 1 (steps S23 and S24). Therefore, the geared motor (GM) 15 is driven and the agitator 11 is operated (steps S1 to S14), and the second timer TM2 is started (steps S23 to S24). When the second timer TM2 reaches the value indicating the second set time, the GM flag 2 is reset to 0 (steps S20 and S21). Therefore, the geared motor (GM) 15 is stopped and the agitator 11 is stopped (steps S11 and S12).

The above describes the basic operation of the timer operational control of the agitator 11. The following will describe the timer operational control of the agitator 11 in further detail specifically.

First, a description will be given of a situation wherein ice making or ice releasing is started when the ice making operation is not being performed, no ice is being released, and the first timer TM1 has not reached the first set time count value (this condition will be hereinafter referred to as "case A").

In the condition before ice making or ice release is started, that is, case A, the GM flag 1 is 0 (steps S1 and S2), and the first timer TM1 is (in the middle of) counting the first set time. Therefore, a select option is set to 1 (step S22). Also, as the second timer TM2 has already reached the second set time, the GM flag 2 has already been set to 0 (steps S20 and S21).

Accordingly, under this condition, the determination result in step S8 is NO, the CM is OFF in step S9, the GM flag 1 in step S10 is 0, the GM flag 2 in step S11 is 0, and the GM is OFF in step S12 as shown in FIG. 4. Therefore, the geared motor (GM) 15 is not being driven, and hence the agitator 11 is stopped. Furthermore, the determination result is NO in step S15, NO in step S16, NO in step S18, YES in step S19, and NO in step S23. Hence, the first timer TM1 is (in the middle of) counting, i.e. the machine is waiting for the first timer TM1 to reach a set count value.

Under this condition, that is in case A, starting the ice making or ice releasing operation causes the geared motor (GM) 15 to be driven (steps S8, S13, and S14, or S8, S9, S10, and S14), and hence the agitator 11 is operated. The determination result in step S16 is switched from NO to YES. Thus, the state wherein the machine is waiting for the first timer TM1 to reach the set count value in step S23 is cleared. Furthermore, the GM flag 2 is reset to 0 in step S17, and the select is reset to 0.

Thereafter, when the ice making or ice releasing operation is stopped, the GM flag 1 is reset to 0 in step S2, so that the compressor (CM) 10 and the geared motor (GM) 15 are stopped (steps S8, S9, S10, S1, and S12). At the same time, the determination result in step S16 is switched to NO, while the determination result in step s18 is switched to YES, the select is reset to 1 in step S22, and the first timer TM1 is reset to start counting the first set time.

Thus, if the ice making or ice releasing operation is performed while the first timer TM1 is counting the first set time, then the agitator 11 is operated when ice is made or ice is released. As soon as the ice making or ice releasing operation is stopped, the agitator 11 is stopped, and the first timer TM1 is reset and restarts counting the first set time. Therefore, since the agitator 11 is not actuated immediately after it has been operated for the ice making or ice releasing, the operating intervals of the agitator 11 are not shortened unnecessarily.

The following will describe an instance in the above case A where a state in which no ice making or releasing operation is performed continues for awhile.

In case A, when the first timer TM1 reaches a set count value, the second timer TM2 is reset to start counting the second set time, and the GM flag 2 is reset to 1, while the select is reset to 2 (steps S23 and S24). Hence, in FIG. 4 the determination result in step S11 is 1, the geared motor (GM) 15 is driven in step S14, and the agitator 11 is operated. When the second timer TM2 reaches a set count value, the GM flag 2 is switched to 0, and the select is switched to 0 (steps S20 and S21). In FIG. 4, the determination result in step S11 is 0. Hence, the GM is turned OFF in step S12, that is, the geared motor (GM) 15 is stopped. This stops the operation of the agitator 11.

As set forth above, in the operating conditions of case A, when the state in which no ice making or releasing operation is performed continues, the agitator 11 remains stopped while the first timer TM1 is counting. When the first timer TH1 reaches the set count value, i.e. when the first set time elapses, the second timer TM2 is reset and started, and the agitator 11 is started. Thereafter, when the second timer TM2 reaches a set count value, i.e. when the second set time elapses, the operation of the agitator 11 is stopped.

Thus, when the second timer TM2 reaches a set count value as mentioned above, the determination result in step S15 is NO, the determination result in step S16 is NO, the determination result in step S18 is YES, and the first timer TM1 is reset and the select is reset to 1 in step S22 as shown in FIG. 5. Accordingly, the determination result in step S18 is switched to NO, while the determination result in step S19 is switched to 1, so that the machine waits for the first timer TM1 to reach the set count value (case A described above) in step S23. Thereafter, this operation is repeated. Hence, the agitator 11 is operated at predetermined intervals by the operation of the first timer TM1 and the second timer TM2.

Next, a description will be given of a case (hereinafter referred to as case B) wherein when no ice is being made or released and the second timer TM2 is counting the second set time after the first timer TM1 has reached the first set time, the ice making or releasing operation is started.

Since the first timer TM1 reaches the first set time before the ice making or releasing operation is performed, the select is set to 2, the GM flag 2 is set to 1 in step S24, and the GM flag 1 is 0 (steps S2 and S4).

Accordingly in this state, the determination result in step S8 is NO, the CM is OFF (the compressor 10 is stopped) in step S9, the determination result in step S10 is 0, the determination result in step S11 is 1, and the GM is turned ON in step S14, causing the geared motor (GM) 15 to be driven as shown in FIG. 4. Accordingly, the agitator 11 is in operation. In FIG. 5, the determination result in step S15 is YES, NO in step S18, NO in step S19, and No in step S20, meaning that the second timer TM2 is counting the second set time, and the machine is therefore waiting for the second timer TM2 to reach the set count value.

In this condition, when the ice making operation is started, the determination result in step S8 is YES, the compressor (CM) 10 is driven in step S13, and the operation of the geared motor (GM) is continued in step S14 as shown in FIG. 4. Thus, the operation of the agitator 11 is continued.

If the ice releasing operation rather than ice making operation is started, then the GM flag 1 is set to 1 in step S6 or S7 of FIG. 3. Therefore, in FIG. 4, the determination result in step S8 is NO, the CM is OFF (the operation of the compressor 10 is stopped) in step S9, and the GM flag 1 is switched to 1 in step S10, and the GM is switched to ON in step S14. Hence, the operation of the geared motor (GM) is continued. Thus, the operation of the agitator 11 is continued.

In case B described above, it the second timer TM2 reaches the second set time during an ice making or releasing operation, then the GM flag 2 is switched to 0 and the select is reset to 0 during the ice making or releasing operation. When the ice making or releasing operation is stopped thereafter, the GM flag 1 is reset to 0 (step S2). Thus, when ice making or release is stopped, the geared motor (GM) 15 is stopped (steps S8, S9, S10, S11, and S12), and the operation of the agitator 11 is stopped. At the same time, the determination result is NO in step S15, NO in step S16, YES in step S18, and the first timer TM1 is reset and the select is reset to 1 in step S22, thus starting the count of the first set time by the first timer TM1.

As set forth above, when the ice making or releasing operation is started while the second timer TM2 is counting the second set time and the second timer TM2 reaches the set count value during the ice making or releasing operation, then the driving of the geared motor (GM) 15 is stopped and operation of the agitator 11 is stopped upon completion of the ice making or releasing operation. At the same time, the first timer TM1 that counts the first set time (the time until the agitator 11 is operated next) is reset and started. Therefore, the agitator 11 will not be operated immediately after the agitator 11 is stopped upon completion of the ice making or releasing operation, so that the operating interval of the agitator 11 will not be unnecessarily shortened.

In case B set forth above, although it is highly unlikely in actual operation because the second set time (a period of time during which the agitator 11 is operated for preventing pieces of ice from fusing and sticking to each other) is shorter than the time required for making ice, following will describe such an instance.

In this case, after the ice making or releasing operation is stopped, the operational flow when the second timer TM2 is counting applies (the determination result in step S15 is YES, NO in step S18, NO in step S19, and NO in step S20). Accordingly, the geared motor (GM) 15 continues to be driven during the second set time, including the time required for the ice making or releasing operation.

As soon as the second timer TM2 reaches a set count value, the GM flag 2 is reset to 0 and the select is reset to 0 in step S21. In FIG. 4, therefore, the GM flag 2 is set to 0 in step S11, so that the GM is OFF, that is the geared motor (GM) 15 is stopped in step S12. This causes the operation of the agitator 11 to be stopped. Furthermore, the determination result is NO in step S15, NO in step S16, and YES in step S18. Thus, in step S22, the first timer TM1 is reset and the select is reset to 1 for the first timer TM1 to start counting anew.

Hence, in this case, the agitator 11 is operated at predetermined intervals by the operations of the first timer TM1 and the second timer TM2.

Thus, the present embodiment is configured so that the timer means causes the agitator 11 to operate for the predetermined second set time after the interval of the predetermined first set time has passed while the ice making operation is stopped. In this case, when the ice making or releasing operation is started, the first timer TM1 for setting the first set time is reset first whenever the operation of the agitator is stopped. With this arrangement, unnecessary operation of the agitator 11 can be avoided.

The embodiment of the present invention employs an auger type ice machine as an ice dispenser. However, the present invention is not limited to an auger type ice machine.

The above configuration of the present invention prevents an agitator from being operated more than necessary, so that pieces of ice can be prevented from fusing and sticking to each other. Moreover, the configuration permits smooth dispensing of ice from an ice storage compartment.

What is claimed is:

1. An ice dispenser comprising:

an ice maker for cooling water to form ice;

an ice storage compartment for storing ice formed by said ice maker;

an ice releasing port in said ice storage compartment for releasing ice stored in said ice storage compartment;

an agitator for agitating ice stored in said ice storage compartment;

a first timing mechanism for counting a first set period of time during which said ice maker forms no ice;

a second timing mechanism for counting a second set period of time during which said ice maker forms no ice; and an operation controller for operating said agitator during the formation of ice by said ice maker and during the release of ice by said ice releasing port, and for operating said agitator during said second set period of time after completion of said first set period of time, and for resetting said first timing mechanism after completion of the formation of ice by said ice maker and after completion of the release of ice by said ice releasing port.

2. The ice dispenser of claim 1, wherein said operation controller is operable to reset said second timing mechanism immediately following completion of said first set period of time, said second timing mechanism being operable to begin counting said second set period of time immediately after being reset by said operation controller.

3. The ice dispenser of claim 1, wherein said second timing mechanism is operable to stop counting said second set period of time after start of the formation of ice by said ice maker and after start of the release of ice by said ice releasing port.

4. The ice dispenser of claim 1, wherein said ice maker comprises:

an ice-making cylinder;

an evaporator around a circumferential surface of said ice-making cylinder; and an auger disposed inside said ice-making cylinder, said auger including a shaft and a spiral blade around a circumferential surface of said shaft.

5. The ice dispenser of claim 4, wherein said ice storage compartment includes a rotating agitator having agitating rods, said agitator being connected to an end of said shaft of said auger.

* * * * *